United States Patent [19]

Martin et al.

[11] 3,945,894

[45] Mar. 23, 1976

[54] BATH COMPOSITION AND METHOD OF ELECTRODEPOSITING UTILIZING THE SAME

[75] Inventors: Sylvia Martin, Detroit; Hans Gerhard Creutz, Yale; Donald Harvey Becking, West Bloomfield, all of Mich.

[73] Assignee: Oxy Metal Industries Corporation, Warren, Mich.

[22] Filed: Apr. 11, 1975

[21] Appl. No.: 567,346

[52] U.S. Cl. ..... 204/55 R; 204/DIG. 2

[51] Int. Cl.[2] ..... C25D 3/22

[58] Field of Search ..... 204/55 R, 55 Y, DIG. 2

[56] References Cited

UNITED STATES PATENTS

| | | | |
|---|---|---|---|
| 2,791,554 | 5/1957 | Winters | 204/55 Y |
| 2,989,449 | 6/1961 | Mackey et al. | 204/55 R |
| 3,186,926 | 6/1965 | Hofmann et al. | 204/49 |
| 3,276,979 | 10/1966 | Strauss et al. | 204/49 |
| 3,294,689 | 12/1966 | Pierce | 204/82 |
| 3,745,099 | 7/1973 | Szilagyi et al. | 204/55 R |
| 3,751,348 | 8/1973 | Szilagyi | 204/55 Y |
| 3,838,026 | 9/1974 | Koch | 204/55 R |
| 3,855,085 | 12/1974 | Rushmere | 204/55 R |
| R27,999 | 4/1974 | Korpium et al. | 204/55 R |

FOREIGN PATENTS OR APPLICATIONS

| | | | |
|---|---|---|---|
| 602,591 | 5/1948 | United Kingdom | 204/55 R |

*Primary Examiner*—F. C. Edmundson
*Attorney, Agent, or Firm*—B. F. Claeboe

[57] ABSTRACT

The instant invention is broadly directed to acid zinc electroplating baths and the use thereof wherein there is utilized water soluble polyglycidols and their derivatives which have been found useful in relatively small additive amounts to the plating solutions and accomplish marked improvements in the brightness of the cathode deposits and also increase the throwing power of the plating solutions.

7 Claims, No Drawings

BATH COMPOSITION AND METHOD OF ELECTRODEPOSITING UTILIZING THE SAME

BACKGROUND OF THE INVENTION

It is known in the art to which this invention pertains that acid zinc baths are characterized by very high anode and cathode efficiencies and also by low anode and cathode polarizations. These properties, however, result in a throwing power of the bath which is relatively poor. Accordingly, acid zinc electroplating baths generally are limited to the plating of relatively simple shapes or to the employment of special and relatively elaborate anode arrangements or complicated racking facilities in order that good metal distribution can be obtained.

The expression employed herein, namely "throwing power" refers to the ability of the acid zinc plating solution to deposit metal uniformly upon an irregularly shaped cathode. In order to measure throwing power in a typical test, a J-shaped electrode is suspended in the plating bath as the cathode between a pair of vertically disposed and generally rectangular anodes. The thickness of the zinc deposited in the deepest recesses of the cathode is then expressed as a percentage of the thickness of the zinc deposited on that portion of the cathode relatively closer to the anode and fully exposed to the anode.

DESCRIPTION OF THE PREFERRED EMBODIMENT

The present invention is concerned with compositions for and methods of electrodepositing zinc on an iron, steel or generally similar substrates from an acid zinc bath. The environmental problems inherent in the disposition of waste cyanide from cyanide zinc plating baths has of course given important emphasis to the utilization of acidic zinc baths. Such baths may be of the sulfate type, of the fluoborate type, chloride type and others as exemplified by acetate, sulfamate or gluconate. At present, however, the latter three baths have not enjoyed widespread commericalization.

Typically, sulfate baths contain from about 100 to approximately 400 grams per liter of zinc sulfate, fluoborate baths contain from about 100 to about 400 grams per liter of zinc fluoborate, and chloride baths generally contain from about 50 to about 300 grams per liter of zinc chloride.

Commonly, ammonium sulfate, ammonium chloride or ammonium fluoborate are added to either the sulfate, chloride or fluoborate baths, respectively, in order to increase their conductivity, while sodium acetate, aluminum sulfate, boric acid or citric acid can be added as a buffer to sulfate baths. Ammonium chloride, sodium chloride, ammonium citrate or aluminum chloride are typically added to chlorine baths. Likewise, ammonium chloride, boric acid or citric acid are added to the fluoborate bath. The pH of the baths generally range from about 1.5 to about 6.5, and the pH is controlled during operation by acid additions.

As was stated hereinabove, aqueous acidic zinc electroplating baths have high anode and cathode efficiencies and relatively low electrode polarizations. However, their throwing power is relatively poor. In fact, the zinc sulfate baths have a negative throwing power when measured in a Haring cell. This disadvantageous situation is overcome by the present invention through the addition of a polymerized glycidol. More particularly, the polymerized addition products of the present invention are selected from the group consisting of polyglycidol and copolymers of polyglycidol with alkylene oxides and their polymers such as ethyleneoxide, propyleneoxide, styreneoxides or epichlorohydrin.

Typically, the basic polyglycidol is formed from glycidol, by very slowly adding glycidol or other suitable solvents to benzene or other suitable solvents containing boron trifluoride or other well-known catalysts. The polyglycidol reaches its limit of solubility in the solvent and precipitates out as the polymer. Alternatively, 1,2 dichloroethane may be utilized as a preferred solvent in substitution for benzene.

The formula for glycidol is as follows:

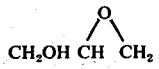

Upon polymerization, the resultant polymer has the following repetitive structure, which of course may also be cross linked as well as linear or both:

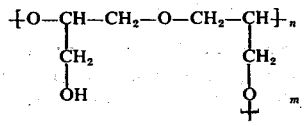

wherein $n$ is an interger between 3 and 10, and $m$ is an interger between 1 to 10.

The basic polyglycidol may be copolymerized with suitable alkylene oxides, ready polymers thereof and as well epichlorohydrin. Typical reactants for copolymerization are the following:

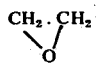

ethylene oxide or

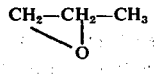

propylene oxide or

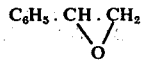

styrene oxide or

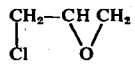

epichlorohydrin

To illustrate the invention further, the following procedures of preparation of the compounds of this invention may be:

EXAMPLE A 40 grams of glycidol was placed into a stirred anhydrous benzene solution to which 1.5 cc of boron trifluoride etherate had been added. The temperature rose to 81°C over a period of 10 minutes. The polyglycidol came out of the solution. The benzene was then poured off into another beaker and was used for the next polymerization. The polymer remaining in the container was then dissolved in 400 cc of water by heating to approximately 86°C and passed through a filtering aid. Approximately 10% of the polymer was water insoluble.

EXAMPLE B 30 grams of glycidol and 20 grams of butylene oxide were placed into a stirred anhydrous benzene solution to which 1.5 cc of boron trifluoride etherate had been added. The temperature rose to about 80°C over a period of ten minutes. The polymer was separated from the benzene, which was then used for the next polymerization. The polymer remaining in the container was then dissolved in 500 cc of water by heating to 86°C and filtered through a filter aid. The insolubles amounted to approximately 3 grams.

EXAMPLE C

In a further method of preparation, 10 grams of polyethylene-glycol having a molecular weight of 400 was added to a stirred anhydrous benzene solution containing 1.5 cc of of boron trifluoride etherate. Then, 40 grams of glycidol was added. The temperature rose to 78°C over a period of 10 minutes. The polymer was separated from the benzene and dissolved in 500 cc of water.

EXAMPLE D 40 grams of glycerin was heated to about 250°C for 2 hours. The product obtained was found to be water soluble and a viscous polymer which was then dissolved in 400 cc of water.

EXAMPLE E 50 grams of glycidol and 10 grams of epichlorohydrin were added to a stirred anhydrous 1,2 dichloroethane solution to which 1.5 cc of boron trifluoride etherate had been added. The temperature rose to about 85°C over a period of 10 minutes. The polymer was separated from the solvent and dissolved in 400 cc of warm water. The insolubles amounted to approximately 7 grams.

The polymerization normally continues until the molecular weight ranges from about 200 to approximately 2000, with a preferred range being from about 300 to 800. As can be appreciated, the relatively lower molecular weight polymers are more soluble in the bath, however, it has been found that lesser amounts of the higher molecular weight polymers are desired for effective utilization in the process.

Homopolymers of glycidol and copolymers of glycidol and the other groups listed above may of course be used in combination with other known zinc brighteners in order to enhance the overall appearance of the zinc plate. For example, there may be employed aromatic aldehydes and ketones, quarternary nicotinates, gelatine, thioureas and like compounds.

In order to describe the instant inventive concept more fully, a number of plates were prepared. An electroplating solution was made up for each of the examples to be described below, and was operated under normal acid zinc bath operating conditions which included a current density of from about 10 to 80 amperes per square foot and at a temperature ranging from approximately 75° to 90°F, with a pH of from about 1.5 to 5.9. The polyglycidol polymer had a molecular weight of from about 300 to 800.

In each instance, a steel J was suspended as a cathode between a pair of planar, vertically disposed anodes. The throwing power was determined by measuring the thickness of the zinc coating on the cathode in closest proximity and directly exposed to the anode as compared with the thickness of the zinc coating at the deepest portion of the recess formed by the turned back portion of the J plate. The throwing power is then expressed as a percentage of the two thicknesses.

The following examples were prepared, operated and measured:

EXAMPLE I

| | |
|---|---|
| Zinc sulfate monohydrate | 200 g/l |
| Boric Acid | 23 g/l |
| Ammonium sulfate | 10 g/l |

The resultant, plated J plate was dull at the deepest recess, and the throwing power was 1 percent.

EXAMPLE II

Example I was repeated with the addition of 0.3 g/l polyglycidol to the bath. The panel was bright with an increase in throwing power of 8 percent.

EXAMPLE III

Example I was repeated with the addition of 1 g/l polyglycidol from Example A to the bath. The result was that the throwing power was increased by 20 percent, and the plate at even the innermost recess of the J plate was semi-bright.

EXAMPLE IV

Example I was repeated with the addition of 1 g/l glycidol-butylene oxide coploymer from Example B. The throwing power was increased to 10% and the panel was semi-bright.

EXAMPLE V

Example I was repeated with the addition of 2 g/l polyglycidol from example D. The throwing power was increased to 8% and the panel has very much improved grain refinement.

EXAMPLE VI

| | |
|---|---|
| Zinc fluoborate | 200 g/l |

A throwing power value of .05% was obtained.

EXAMPLE VII

Example VI was repeated with the addition of 0.5 g/l polyglycidol from Example A. The result was that the throwing power was increased to 13 percent and the place showed good grain refinement.

EXAMPLE VIII

| | |
|---|---|
| Zinc Chloride | 110 g/l |
| Ammonium chloride | 160 g/l |

The throwing power was determined to be 20 percent, and the plate in the recess was dull and uneven.

EXAMPLE IX

Example VIII was repeated with the addition of 0.1 g/l polyglycidol from Example A. The throwing power was increased by 50 percent, i.e. from 20 to 30 percent, and the J plate was uniformly semi-bright.

EXAMPLE X

Example VIII was repeated with an addition of 2 g/l copolymer of glycidol and polyethylene glycol molecular weight 400 from Example C. The throwing power was increased to 26 percent.

EXAMPLE XI

| | |
|---|---|
| Zinc sulfate | 200 g/l |

A throwing power value of 1% was obtained.

EXAMPLE XII

Example XI was repeated with the addition of 0.8% polyglycidol from Example A. The throwing power was determined to be 15 percent. This increase in throwing power was accompanied by an increase in brightness and uniformity of the electrodeposit in the J plate recess.

EXAMPLE XIII

Example XI was repeated with an addition of 0.5 g/l, glycidol-epichlorohydrin copolymer. The throwing power was increased to 8% and the product showed improved grain refinement.

Various changes and modifications in the solutions and procedures have been described herein, and these and other variations may of course be practiced without departing from the spirit of the invention or the scope of the subjoined claims.

What is claimed is:

1. A composition for the electrodeposition of zinc upon a substrate, which comprises an aqueous acidic solution containing a soluble zinc salt in which the zinc concentration is present in an amount of about 20 to 200 grams per liter, and a polymeric additive selected from the group consisting of polyglycidol and copolymers of polyglycidol with an alkylene oxide or their ready polymers and epichlorohydrin.

2. A composition as defined in claim 1, in which the polymeric additive is present in the range from about 0.05 to 100 grams per liter.

3. A composition as defined in claim 1, in which the molecular weight of the polymeric additive is between about 200 to approximately less than 2000.

4. A composition as defined in claim 1, in which the zinc salt is selected from the group consisting of zinc sulfate, zinc chloride, zinc fluoborate, zinc acetate, zinc sulfamate or zinc gluconate and others related thereto.

5. A composition for the electrodeposition of zinc as defined in claim 4, in which the zinc acetate is present in an amount between about 60 to 300 grams per liter, zinc gluconate is present in an amount between approximately 60 to 200 grams per liter, zinc sulfamate is present in an amount of about 60 to 150 grams per liter, and other zinc salts are present in generally equivalent amounts.

6. A method for electrodepositing zinc to provide enhanced throwing power and an improved brightened electrodeposit, which comprises forming an acidic aqueous zinc electroplating bath which includes therein a zinc salt selected from the group consisting of zinc sulfate, zinc fluoborate, zinc chloride, zinc acetate, zinc sulfamate, or zinc gluconate, and dissolving therein a polymeric additive selected from the group consisting of polymerized polyglycidol and copolymers of polyglycidol and alkylene oxides, the ready polymers thereof, and epichlorohydrin.

7. A method for the electrodeposition of zinc as defined in claim 6, wherein the zinc sulfate is present in an amount from about 150 to about 400 grams per liter, the zinc fluoborate is present in an amount from about 150 to about 400 grams per liter, the zinc chloride is present in an amount from about 75 to 240 grams per liter, zinc acetate is present in an amount from approximately 60 to 200 grams per liter, the zinc gluconate is present in an amount from about 60 to 200 grams per liter and zinc sulfamate is present in an amount from about 60 to 150 grams per liter.

* * * * *